US006225946B1

(12) United States Patent
Kreutel et al.

(10) Patent No.: US 6,225,946 B1
(45) Date of Patent: May 1, 2001

(54) METHOD AND APPARATUS FOR A LIMITED SCAN PHASED ARRAY OF OVERSIZED ELEMENTS

(75) Inventors: Randall William Kreutel, Woodinville, WA (US); Paul Chiavacci, Stoneham, MA (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/383,610

(22) Filed: Aug. 26, 1999

(51) Int. Cl.[7] ..... H01Q 3/26
(52) U.S. Cl. ..... 342/368
(58) Field of Search ..... 342/368

(56) References Cited

PUBLICATIONS

Amitay, Noach and Gans, Michael J., "Design of Rectangular Horn Arrays with Oversized Aperture Elements", IEEE *Transactions on Antennas and Propogation,* vol. AP–29, No. 6, Nov. 1981, pp. 871–884.

*The Phase Array Handbook,* Robert Mailloux, Artech House, Boston, 1994, pp. 460–467.

"Surface Wave Effects and Blindness in Phased Array Antennas", Oliner, Arthur A., *Phased Array Antennas,* Artech House, 1972, pp. 107–111.

R.J. Mailloux, An Overlapped Subarray for Limited Scan Application, IEEE Transactions of Antennas and Propagation, vol. 22(3), pp. 487–489, May 1974.*

* cited by examiner

*Primary Examiner*—Thomas H. Tarcza
*Assistant Examiner*—Fred H Mull
(74) *Attorney, Agent, or Firm*—James E. Klekotka; Frank J. Bogacz

(57) ABSTRACT

Mutual coupling between radiative elements (210, FIG. 2) in a phased array antenna (110, FIG. 1) is employed to extend the effective aperture dimension of a radiative element. Mutual coupling is used to force selected modal resonances to occur in the radiative elements (210). The forced modal resonances create zeroes of transmission which are employed to improve the roll-off characteristics of the radiative element's radiation pattern.

5 Claims, 2 Drawing Sheets

METHOD AND APPARATUS FOR A LIMITED SCAN PHASED ARRAY OF OVERSIZED ELEMENTS

FIELD OF THE INVENTION

The present invention pertains generally to phased array antennas and, more particularly, to a limited scan phased array of oversized elements and methods relating thereto.

BACKGROUND OF THE INVENTION

Phased array antennas are known in the art to be well suited for communication applications, which require substantial gain, multiple agile beams, and broad surface area coverage, for example, on satellites in mid-earth or geosynchronous orbits. The diameter of the earth as viewed from a geosynchronous satellite subtends a satellite field of view of approximately only ±8.5 degrees. In addition, it is well known that phased array antennas have terrestrial applications.

Phased array antennas typically include a plurality of radiative elements arranged in a two-dimensional pattern. To decrease the number of radiative elements, and therefore the costs of building a phased array antenna, radiative elements are often spaced as far apart from one another as possible within the design specifications of the antenna. Radiative elements for antennas which are to be utilized on satellites in mid-earth or geosynchronous orbits can be separated much further than radiative elements for antennas to be utilized on satellites in low earth orbits.

Separating radiative elements beyond the wavelength $\lambda$ of the transmitted or received signals results in the formation of grating lobes (i.e., beams that form in directions other than the direction of interest). Grating lobes result in a reduction of antenna gain in both transmit and receive modes. Accordingly, it is generally preferable to eliminate or reduce the power radiated into grating lobes.

Typically, grating lobes are eliminated or diminished by using smaller radiative elements which are spaced closer together. Natural zeros, or nulls, in the radiation pattern occur at angles between the main lobe and the grating lobes. Accordingly, the aperture of the element is typically designed to control the location of the natural zeros.

One approach to designing antenna element apertures is based on achieving an extended aperture dimension by creating "overlapping subarrays" which utilize interconnecting networks feeding the array elements. These interconnecting networks add significant complexity to the beamforming process and, consequently, have had very limited practical application.

It is well known to those skilled in the art that under certain conditions phased arrays are subject to an anomalous null, which exists inside the natural zero, a phenomenon known as "blindness". One example of the blindness phenomenon is described in detail in a paper by Oliner, Arthur A., "Surface Wave Effects and Blindness in Phased Array Antennas", from Phased Array Antennas, ARTECH House, 1972, pp. 107–112.

Another example of a type of "blindness" applicable to arrays with large element spacing (i.e. greater than one wavelength) is referred to herein as "forced modal resonance" and is described in the Amitay and Gans paper, "Design of Rectangular Horn Arrays with Oversized Aperture Elements", IEEE Transactions on Antennas and Propagation, Vol. AP-29, No. 6, pp. 871–884 (November 1981).

The blindness phenomenon is typically manifested by the existence of deep "anomalous" nulls in the embedded element pattern. If the array is large and the element pattern is for an interior element, then these nulls appear symmetrically disposed. Edge elements demonstrate the nulls asymmetrically. The existence of anomalous nulls in the embedded element pattern means that if the array antenna is phased to point a beam in those directions, total reflection will occur. Heretofore, complex and costly techniques have been developed to eliminate or reduce the effect of anomalous nulls within the antenna's FOV requiring additional hardware and software.

Conventional phased array antennas are seldom proposed as antennas for high-gain, limited-scan applications because the required element spacing is small, and the resulting number of elements and phase shifters is excessively large. It has long been recognized, however, that if flat-topped radiation patterns could be synthesized to suppress the grating lobes, arrays of relatively few but larger sub-arrays or elements could be used for these applications.

Accordingly, a need exists for extending the effective aperture of the radiative elements of a phased array antenna without incurring additional complexity and cost to overcome the blindness phenomenon.

BRIEF DESCRIPTION OF THE DRAWINGS

The invention will be better understood from a reading of the following detailed description taken in conjunction with the drawing in which like reference designators are used to designate like elements, and in which.

DETAILED DESCRIPTION OF PREFERRED EMBODIMENT

A preferred embodiment of the present invention provides a technique for extending the effective aperture of a radiating element of a phased array antenna through use of radiative coupling and selective enhancement of the coupling through "forced" modal resonances. Aspects of the invention allow the elements of a phased array antenna to be widely spaced so as to permit grating lobes to form outside the field of view (FOV) of the antenna, but they restrict radiative losses associated with such grating lobes. This allows the number of elements in the phased array to be minimized, thereby reducing cost, and complexity while maintaining high-power utilization efficiency.

In addition, the embedded element pattern (i.e., the radiation pattern of an array element measured with all other elements terminated in matched loads) is shaped such that the array element radiates minimally in the directions of the grating lobes at all scan angles within the antenna's FOV. This allows the amount of power radiated into the grating lobes to be minimized in order to provide acceptable associated gain reduction in the main lobe.

A phased array antenna built in accordance with the teachings of the present invention is particularly adapted to form and scan antenna beams over a limited FOV, such as that seen from a medium-earth orbit (MEO) satellite or a geosynchronous orbit (GEO) satellite.

Figure 1:
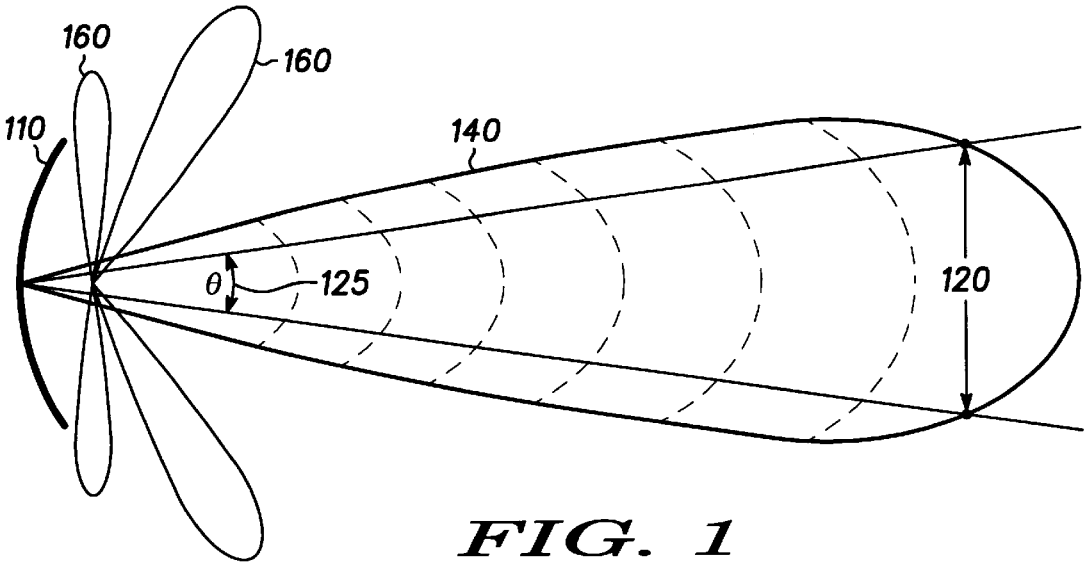
FIG. 1 illustrates a narrow scan radiation pattern of a phased array antenna 110 of a satellite (not shown) orbiting at a pre-determined distance from the earth in accordance with a preferred embodiment of the invention.

FIG. 1 illustrates a narrow scan radiation pattern of a phased array antenna 110 of a satellite (not shown) orbiting at a pre-determined distance from the earth, in accordance with a preferred embodiment of the invention. Antenna 110 is configured to have a field of view having an angular dimension 125 ($\theta_{FOV}$) that is wide enough to encompass the earth from the satellite's orbital position (i.e., $\theta_{FOV} \approx 17°$ for a geosynchronous satellite). As illustrated in FIG. 1, a radiation pattern from antenna 110 includes a main lobe 140 having beamwidth 120 and grating lobes 160.

The directional properties of an antenna are illustrated by its radiation pattern, which represents the relative radiated power versus direction. Generally, main lobe 140 is the largest lobe in three-dimensional space and represents the beam through which the antenna operates in both transmit and receive modes. As illustrated in FIG. 1, main lobe 140 has a beam direction associated with it, and the beam direction is scanned within the limits established by the FOV of the antenna. Scan limits can also be established by the creation of grating lobes. When a scan angle exceeds the limits of the antenna array, grating lobes can appear. Grating lobes 160 can cause interference problems, and typically they are controlled within the FOV and minimized outside FOV.

In a preferred embodiment, an element spacing is established that allows grating lobes to exist in visible space but only outside the antenna's field of view. This means that the grating lobe angle is made larger than the FOV/2. In this manner, the number of radiating elements is minimized, and the number of associated components (e.g., phase shifters, amplifiers, etc.) is minimized.

In addition, the amount of power radiated into the grating lobes is minimized. In a preferred embodiment, the embedded element pattern is shaped such that the array element radiates minimally in the direction of the grating lobe for all scan angles within the FOV of the antenna. Desirably, the embedded element pattern is the radiation pattern of an array element measured with all other elements terminated in matched loads.

Figure 2:
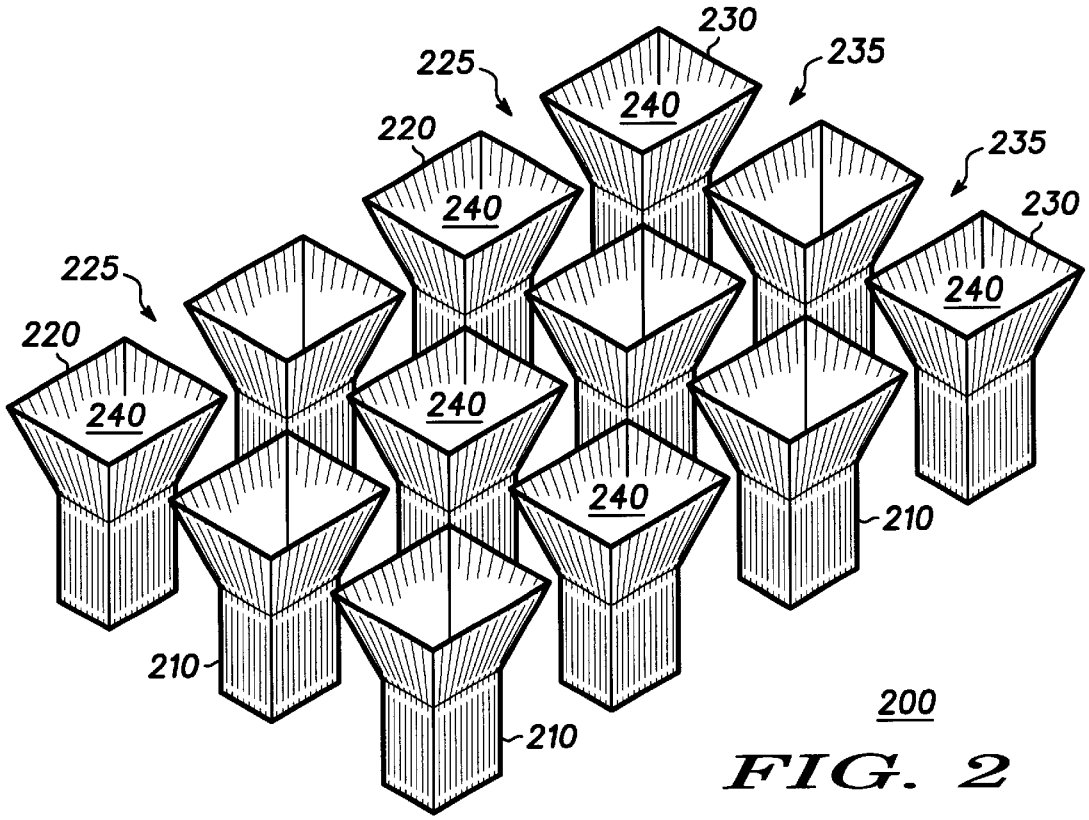
FIG. 2 is a simplified block diagram of a portion of a phased array antenna in accordance with a preferred embodiment of the invention.

FIG. 2 is a simplified block diagram of a portion of a phased array antenna in accordance with a preferred embodiment of the invention. In the embodiment shown, phased array antenna 200 comprises a plurality of waveguide-fed radiative elements 210.

As illustrated in FIG. 2, waveguide-fed radiative elements 210 comprise apertures 240 having first lengths 230 and second lengths 220. Waveguide-fed radiative elements 210 are separated from each other by a first separation distance 225 in one dimension and by a second separation distance 235 in a second dimension. Coupling network (not shown) is used to interface radiative elements 210 to the other on-board transmit and receive subsystems (not shown).

In a preferred embodiment, apertures 240 are substantially the same for the elements in the antenna. In addition, first separation distances 225 are substantially equal, and second separation distances 235 are substantially equal. Iterative techniques are used to establish the dimensions. For example, final sizing may involve iterating between a driven element and a parasitic element.

In alternate embodiments, the aperture sizes can be different and the separation distances can be different. Those skilled in the art will recognize that apertures 240 can be established using mechanical and electrical means which are different from the waveguide horns illustrated in FIG. 2.

In FIG. 2, 12 radiative elements are illustrated. The number of radiative elements illustrated is chosen for illustration, and it is not intended to limit the scope of the invention. Each radiative element 210 has an element pattern associated with it. An array pattern can be associated with an array of radiative elements 210. An antenna pattern can be formed using the products of the array pattern and the element patterns. In a preferred embodiment, the location of element pattern nulls is controlled to coincide with the position of the peak of the first sidelobes of the array pattern to optimize the antenna pattern. Antenna 200 comprises a plurality of radiative elements 210, and radiative elements 210 can be grouped into subsets for generating individual beams.

Figure 3:
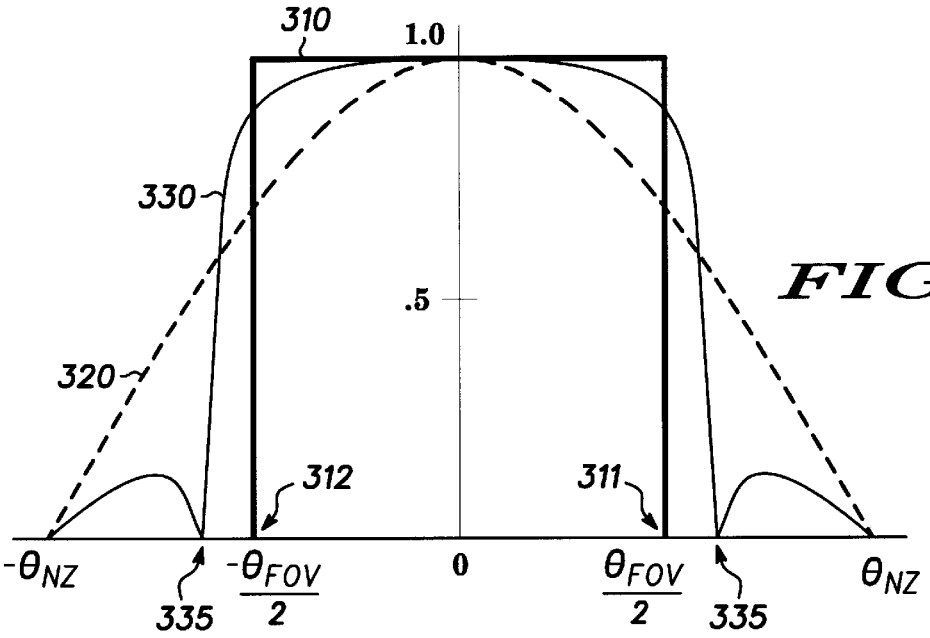
FIG. 3 illustrates a graphical representation of a number of radiation patterns associated with phased array antennas in accordance with a preferred embodiment of the invention.

FIG. 3 illustrates a graphical representation of a number of radiation patterns associated with phased array antennas in accordance with a preferred embodiment of the invention. Ideal radiation pattern 310, typical radiation pattern 320, and an improved radiation pattern 330 are shown in FIG. 3. In FIG. 3, values along the X-axis represent the angular distance from the center point 0 of the antenna's radiation pattern, whereas values along the Y-axis represent the normalized gain of the antenna beam.

Point 311 on the X-axis, having a value $\theta_{FOV}/2$, represents one-half the width of the antenna beam $\theta$ in the positive direction, and point 312, having a value $-\theta_{FOV}/2$, represents one-half the width of the antenna beam $\theta$ in the negative direction. As shown in FIG. 3, an ideal radiation pattern, shown by curve 310, is pulse-shaped, having a normalized gain value of near unity over the entire FOV and then rolling off to zero outside the FOV. Rapid roll-off is essential if the element spacing permits grating lobe formation and the grating lobes consume negligibly small power.

The aperture of the element allowed by the element spacing is generally not large enough to achieve the desired roll-off. Therefore, some means of extending its aperture dimension is necessary. In a preferred embodiment, the radiative coupling between the array elements is used to extend the aperture dimension. The radiative coupling is selectively enhanced by forcing modal resonance(s) to occur in the radiative elements. The forced modal resonances create zeroes of transmission that are employed to improve the roll-off characteristics of the element pattern.

If grating lobe formation is permitted, a grating lobe (not shown) will form beyond the angle of the natural zero $\theta_{NZ}$. It is well known that the ideal element pattern represented by curve 310 is not realizable in practice. With an element space of $d/\lambda$ where d is the distance between radiative elements and $\lambda$ is the cutoff wavelength of received signals, the maximum aperture dimension of the elements is $d/\lambda$ and that dimension yields a poor approximation to the ideal pattern.

The aperture dimension of the element allowed by the element spacing is generally not large enough to achieve the desired roll-off. Instead, the typical radiation pattern generally looks like curve 320 of FIG. 3, where the gain is at a maximum at angle 0°, but rolls off to zero outside the FOV, reaching a natural zero, or null at $\theta_{NZ}$. Any radiation pattern beyond $\theta_{NZ}$ is due to grating lobes and is outside the FOV of the antenna.

According to a preferred embodiment of the invention, the ideal element aperture is extended to provide an element pattern that more closely matches the ideal pulse shape of curve 310 in FIG. 3. An example of a typical radiation pattern shape achieved using the invention is shown in FIG. 3 as curve 330. The shape of curve 330 is achieved by inducing radiative coupling between array elements and selectively forcing carefully chosen modal resonances to occur in the radiative elements. The forced modal resonances create zeroes of transmission (e.g., forced zero 335 in FIG. 3) which are employed to improve the roll-off characteristics of the element's radiation pattern.

Heretofore, methods have been developed to eliminate or reduce the effect of anomalous nulls within the FOV of the antenna. A preferred embodiment of the present invention employs anomalous null controlling techniques to introduce, or "force", anomalous nulls to strategic positions within the antenna's FOV in order to affect the shape of the radiation pattern of a radiative element.

Figure 4:
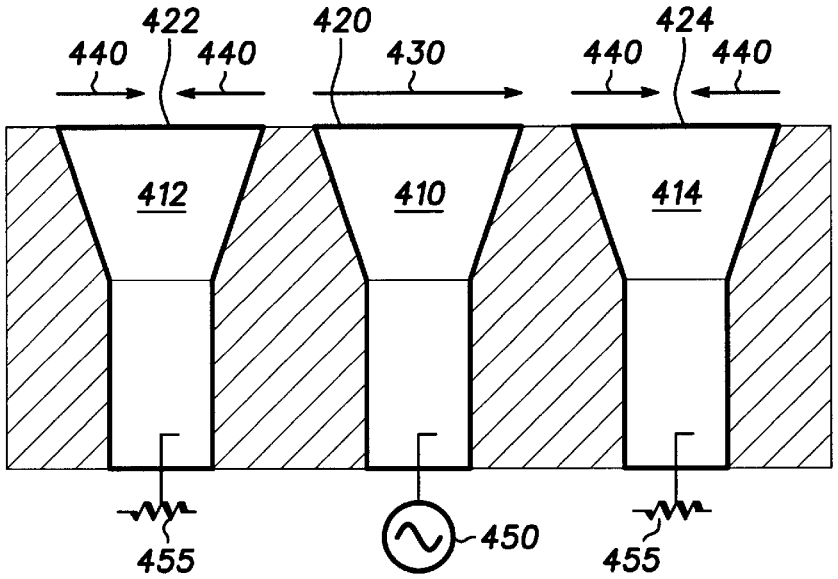
FIG. 4 shows a simplified block diagram of a portion of a phased array antenna illustrating adjacent waveguide apertures in accordance with a preferred embodiment of the invention.

FIG. 4 shows a simplified block diagram of a portion of a phased array antenna illustrating adjacent waveguide apertures in accordance with a preferred embodiment of the invention. The size and material of waveguide elements 410, 412, 414 are selected to control the modes in the waveguide or the modes that radiate from the waveguide. In addition, the size of waveguide apertures 420, 422, 424, including the throats and flares, is selected to control the modes in the waveguide or the modes that radiate from the waveguide. Different E (electric field) modes and H (magnetic field) modes are excited to affect the placement of the blindness null.

In a preferred embodiment of the invention, mode selection and excitation between waveguide apertures are achieved by proper selection of the dimensions of the radiative elements, the proximity of the radiative elements to one another, and/or the materials used to construct the radiative elements, and other components. The shape of the radiation pattern of an element is controlled utilizing the mutual coupling phenomenon.

When a waveguide type array element is excited by a radio frequency signal source in the array environment, radiated fields are induced in the aperture of neighboring elements. The induced fields can be decomposed into mode sets identifiable with waveguide elements. Most of these modes will be below cutoff in the waveguide element and will therefore be reflected (assuming negligible evanescent mode coupling) from the radiative element terminal. According to the present invention, a mode is selected from among the set of reflected modes. The selection is based on the radiative properties of the mode together with the array geometry so as to provide the appropriate influence on the array element pattern shape.

In the embodiment of FIG. 4, mutual coupling is achieved by exciting center waveguide element 410. Excitation of center element 410 induces other modes in the surrounding waveguide elements. Preferably, the amount of mutual coupling is controlled to induce modes in the surrounding waveguides 412 and 414 that force a zero at the angle just outside the field of view of the antenna. By forcing the zero at this angle, the grating lobes are minimized, resulting in minimized amount of power radiating from them. Accordingly, most of the power is radiated into the main lobe (i.e., the beam within the FOV of the antenna).

In FIG. 4, the single arrows 430 indicate the direction of the electric field E in the waveguide itself, and the double arrows 440 indicate modes induced in the surrounding waveguides. The modes in the center waveguide are called driven modes, and the modes induced in the surrounding waveguides are called parasitic modes.

In addition, a single excitation source 450 is shown coupled to waveguide element 410. Loads 455 are shown coupled to waveguide elements 412 and 414.

Figure 5:
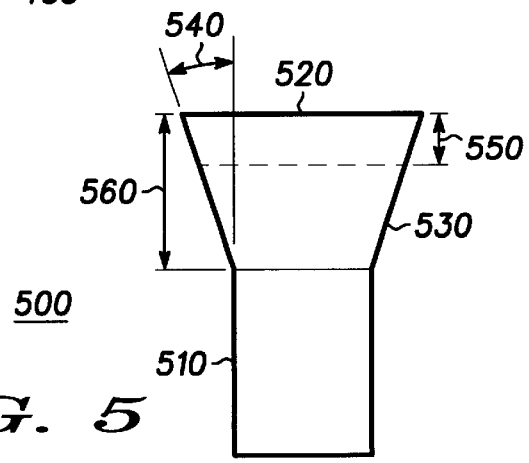
FIG. 5 illustrates a simplified block diagram of an open-ended waveguide horn in accordance with a preferred embodiment of the invention.

FIG. 5 illustrates a simplified block diagram of an open-ended waveguide horn in accordance with a preferred embodiment of the invention. Waveguide horn 500 can be used to implement any of the waveguide-fed radiating elements 210 shown in FIG. 2. In alternate embodiments, other waveguide elements can be used to implement any of waveguide-fed radiating elements. Waveguide horn 500 comprises throat 510 and flare 530.

FIG. 5 illustrates one type of structure for controlling the mutual coupling between the waveguides. By selecting the element flare angle ($\infty$) 540 properly, the depth 550 of the mode penetration is controlled. This allows the amount of mutual coupling and resonant modes to be determined. In other words, the shape of horn 500 is controlled to ensure that the impedance of certain modes is infinite (i.e., completely reflected). The shape of horn 500 is designed to behave like an open circuit such that specifically selected reflected modes do not propagate at the mouth 520 of horn 500, which consequently forces a resonance at these modes.

The specifically selected reflected modes are determined to introduce nulls inside the aperture radiation pattern to achieve the desired radiation pattern shape. In the embodiment of FIG. 5, mode penetration depth 550 is changed to move the position of the anomalous null within the aperture radiation pattern of the radiative element.

In a preferred embodiment, flare length 560 of waveguide element 500 is selected so as to position the mode cutoff plane in the aperture of the radiating element at resonance. In alternate embodiments, other methods are employed to force resonance of the selected mode, including selecting the particular material of the array elements.

In alternate embodiments, more than one reflected mode is selected to achieve the desired radiation pattern. For example, in the case of an overmodal square aperture waveguide, desired pattern control in the E plane may require the $HE_{11}$ mode, which may be achieved by way of a linear combination of $TE_{11}$ and $TM_{11}$ modes, and the desired pattern control in the H plane may require the $TE_{20}$ mode.

Control of the flare length of the horn is one method by which both modes may be placed into resonance. For linear polarization, the aperture can be rectangular, and separate flare angles can be defined in each plane. For square guides with circular polarization, simultaneous solutions (more restriction but they exist) must be formed.

The forced zeros in the embedded element pattern tend to appear at or near the angular location of the peak radiative fields associated with the selected modes. The angular location is determined by computing the radiation pattern of the selected mode including the array factor. "Odd" modes are, in general, associated with an "odd" array factor, and "even" modes are associated with an "even" array factor. Thus, the forced zeros will always appear symmetrically disposed in the element factor.

When a fully implemented phased array including the forced modal resonances is scanned to form and point a beam in the direction of a forced zero, the selected mode is set into resonance, and total reflection occurs at the element terminal.

A method for extending the aperture of a radiative element in a phased array antenna has been described in detail above. The invention is particularly suitable in applications where the phased array antenna is used to form and scan beams over a limited FOV (e.g., the solid angle subtended by the earth as viewed from a geosynchronous satellite).

The use of mutual coupling between the array elements is employed to induce forced modal resonances, which in turn create zeroes of transmission within the radiation pattern of the aperture of the element, so that the characteristics of the element radiation pattern can be significantly improved.

In other words, the concept of forced "blindness" is employed to improve the element radiation pattern shape and thus the overall performance of an oversized element phased array antenna. The oversized elements are chosen consistent with a limited field of view requirement and the desire to minimize the number of elements of the antenna desired for that requirement. For such a scenario, grating lobes appear in the visible space but are restrained to be outside of the FOV. The main requirement on grating lobes is that the power radiated into them must be tolerably small. The "forced" blindness concept provides the mechanism for minimizing the power radiated into the grating lobes.

Although the invention has been described in terms of the illustrative embodiments, it will be appreciated by those skilled in the art that various changes and modifications may be made to the illustrative embodiments without departing from the spirit or scope of the invention. It is intended that the scope of the invention not be limited in any way to the illustrative embodiment shown and described but that the invention be limited only by the claims appended hereto.

What is claimed is:

1. A method for increasing an aperture of a radiative element, said method comprising the steps of:

a) determining a size for a phased array antenna comprising N radiative elements, wherein N is a positive integer;

b) determining a size for a first one of said N radiative elements;

c) determining a field of view for said phased array antenna;

d) determining a size for a second one of said N radiative elements;

e) establishing a spacing between said first one and said second one, whereby a grating lobe is formed outside said field of view;

e1) spacing each of said N radiative elements a distance from an adjacent radiative element to induce mutual radiative coupling between radiative elements;

f) selecting a radiating mode for said first one which is resonant within an aperture of said first one;

g) exciting said radiating mode in said aperture of said first one;

h) selecting a higher-order radiating mode that is resonant within said aperture of said first one;

h1) increasing said aperture of each of said N radiating elements until nulls are created in the radiating signal within a field of view of each of said N radiating elements;

i) exciting said higher-order radiating mode in said second one using mutual coupling between said first one and said second one; and j) modifying said first one to optimize said higher-order radiating mode.

2. The method as claimed in claim 1, wherein step (j) further comprises the step of modifying said second one to minimize said grating lobe.

3. The method as claimed in claim 1, wherein step (j) further comprises the step of modifying said first one to minimize said grating lobe.

4. The method as claimed in claim 1, wherein said method further comprises the steps of:

k) determining a size for a third one of said N radiative elements;

l) establishing a spacing between said first one and said third one, whereby a second grating lobe is formed outside said field of view;

m) selecting a second higher-order radiating mode that is resonant within said aperture of said first one;

n) exciting said second higher-order radiating mode in said third one using mutual coupling between said first one and said third one; and o) modifying said third one to optimize said second higher-order radiating mode.

5. The method as claimed in claim 4, wherein step (o) further comprises the step of modifying said third one to minimize said second grating lobe.

* * * * *